US005488349A

United States Patent [19]

Erickson et al.

[11] Patent Number: 5,488,349

[45] Date of Patent: Jan. 30, 1996

[54] MULTIPLE RANGE VARIABLE RESISTOR

[76] Inventors: Bruce L. Erickson, 11732 Winnetka Ave., North, Champlin, Minn. 55316; Allen H. Stull, 14963 Nowthen Blvd., Ramsey, Minn. 55303

[21] Appl. No.: 161,656

[22] Filed: Dec. 2, 1993

[51] Int. Cl.[6] ..... H01C 10/32

[52] U.S. Cl. ..... 338/171; 338/148; 338/128; 338/180

[58] Field of Search ..... 338/148, 149, 338/171, 180, 128

[56] References Cited

U.S. PATENT DOCUMENTS

| | | | |
|---|---|---|---|
| 1,371,287 | 3/1921 | Wirt . | |
| 2,777,925 | 1/1957 | Stolz | 201/62 |
| 2,813,955 | 11/1957 | Schelling | 201/48 |
| 3,188,595 | 6/1965 | Hult et al. | 338/148 |
| 3,214,720 | 10/1965 | Ruckelshaus | 338/148 |
| 3,252,121 | 5/1966 | Tice | 338/180 |
| 3,413,589 | 11/1968 | Greene | 338/180 |
| 3,846,733 | 11/1974 | Beetle | 338/133 |
| 4,021,768 | 5/1977 | Stuckey | 338/180 |
| 4,060,788 | 11/1977 | Numata et al. | 338/128 |
| 4,978,939 | 12/1990 | Zeitvogel | 338/176 |
| 5,004,996 | 4/1991 | Shibazaki | 338/36 |

*Primary Examiner*—Marvin M. Lateef
*Attorney, Agent, or Firm*—Larry M. Jennings

[57] ABSTRACT

A multiple range variable resistor and potentiometer suitable for use in the repair or manufacture of hearing aids and other miniature applications is disclosed. The user of the device can select the desired resistance range thereby allowing one component to be used in many different applications and reducing inventory requirements. It provides increased resistance to contamination of the internal components compared to conventional hearing aid volume controls and is not damaged by over-turning of the control knob in either direction. It can be manufactured for the same cost as conventional single range potentiometers.

19 Claims, 5 Drawing Sheets

MULTIPLE RANGE VARIABLE RESISTOR

BRIEF DESCRIPTION OF THE PRIOR ART AND SUMMARY OF THE INVENTION

The present invention relates to variable resistors, particularly to multiple-range variable resistors. It is to be understood at the outset that the term variable resistor as used herein includes potentiometers, potentiometric devices and adjustable or settable resistors. Manufacturers of electronic equipment have commonly used a variety of resistive elements to control the function of electrical and electronic products, particularly miniaturized products for example, hearing aids, radio controlled devices, remote sensors, and the like.

Variable resistors adapted for use as hearing aid volume controls are commonly found to be the cause of hearing aid malfunctions with the result that many hearing aids must be removed from service in order to effect replacement of defective volume controls. One common mode of hearing aid volume control failure is the over-turning of the external volume control knob. Such over-turning can cause the volume control shaft to break, necessitating replacement of the volume control assembly. A second very common cause of hearing aid volume control failure is the deleterious effect of accumulated moisture, wax, oils, salts, and acids on the internal components of the device.

The high incidence of hearing aid failure has given rise to a significant hearing aid repair industry. It is to the advantage of both original equipment manufacturers and repair organizations to stock the smallest number of components necessary to build or restore the device of interest in accordance with the applicable specifications. The present invention overcomes the necessity of maintaining an inventory of several distinct ranges of volume control devices by allowing the technician to very readily select the desired range at the time the device is installed. The present invention is a single component which can replace at least five components of the type currently in use.

A second advantage of the present invention is that it is adapted to provide increased resistance to the penetration of foreign material into the internal components of the device than is currently available with conventional hearing aid volume control. It is believed that the ability of the invention to exclude foreign material will result in improved reliability compared to models now in use.

A third advantage is that the present invention having user selectable multiple resistance ranges is designed to be the same size or smaller than the single-range devices which it is designed to replace. It is anticipated that the cost to manufacture the present invention will be comparable to the cost to manufacture the conventional products it replaces.

A fourth advantage of the present invention is that it is not damaged by over-turning of the control knob in either direction. The position of the variable resistance contacts is controlled by an assembly which disengages when the contacts reach their limits of travel and automatically re-engage when the control is turned the other direction.

These and other advantages of the present invention are set forth in the following description.

DETAILED DESCRIPTION OF THE DRAWINGS

Figure 1:
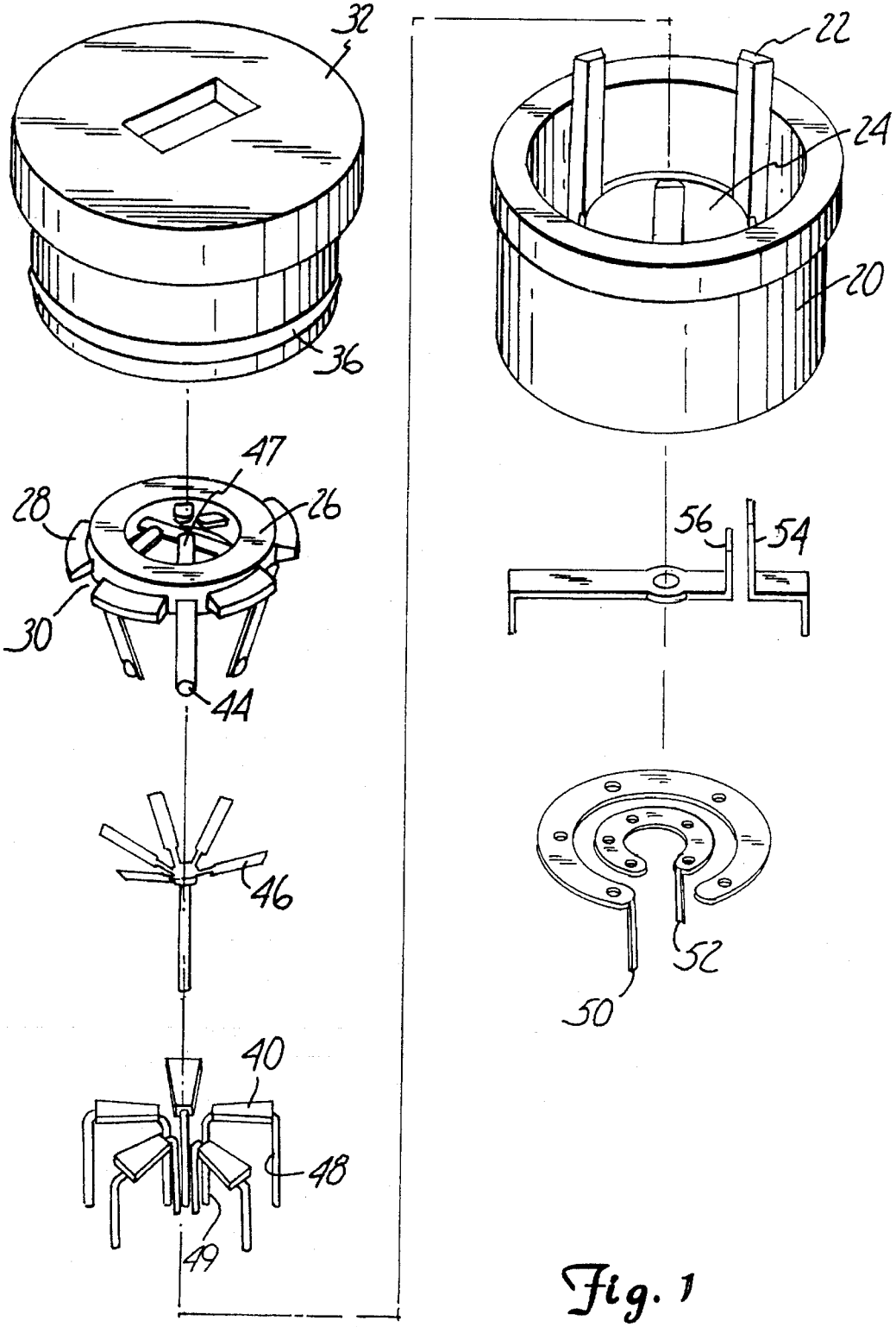
FIG. 1 shows an exploded perspective view of an embodiment of the invention.
Figure 2:
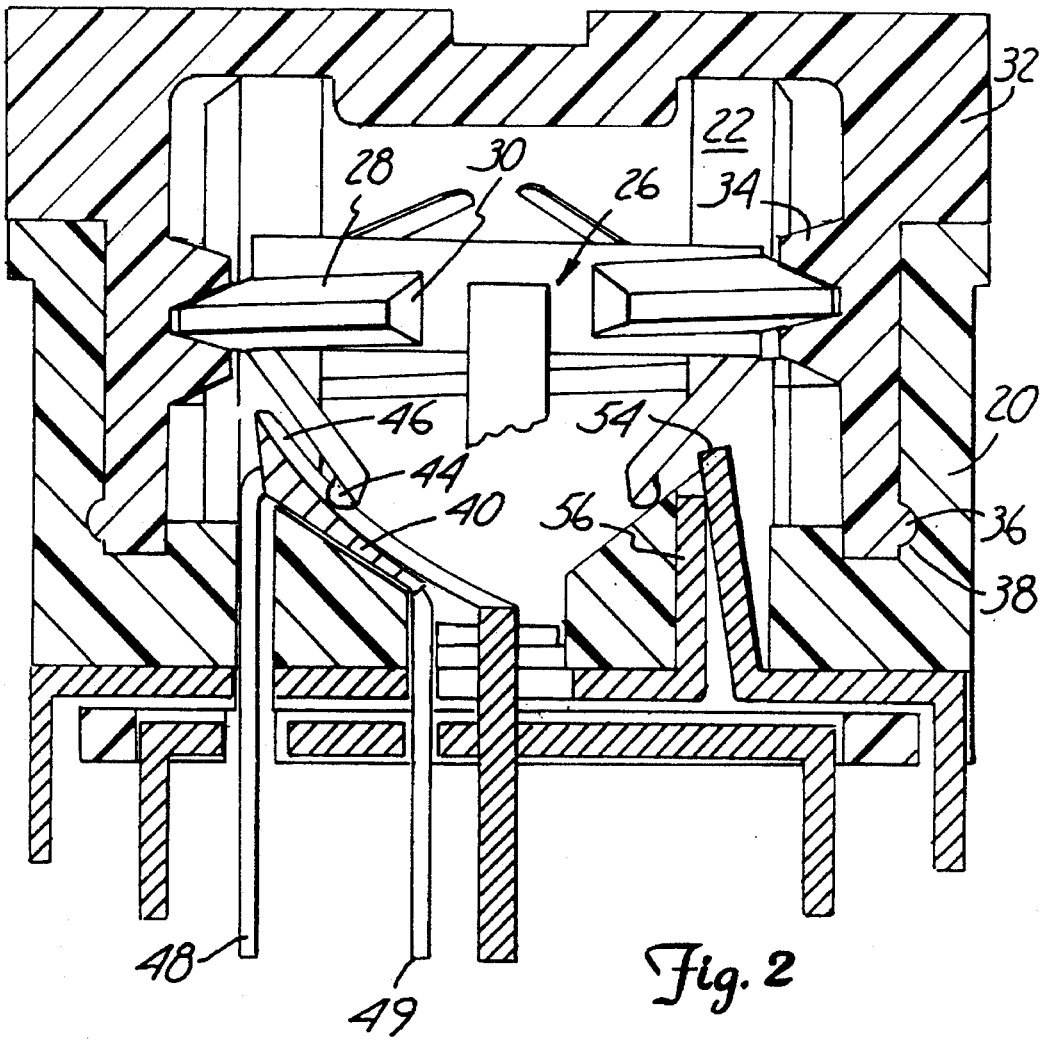
FIG. 2 shows a cross-sectional elevation view of the embodiment depicted in FIG. 1 wherein the moveable contacts are set at mid-range and the switch mechanism is in the closed position.
Figure 4:
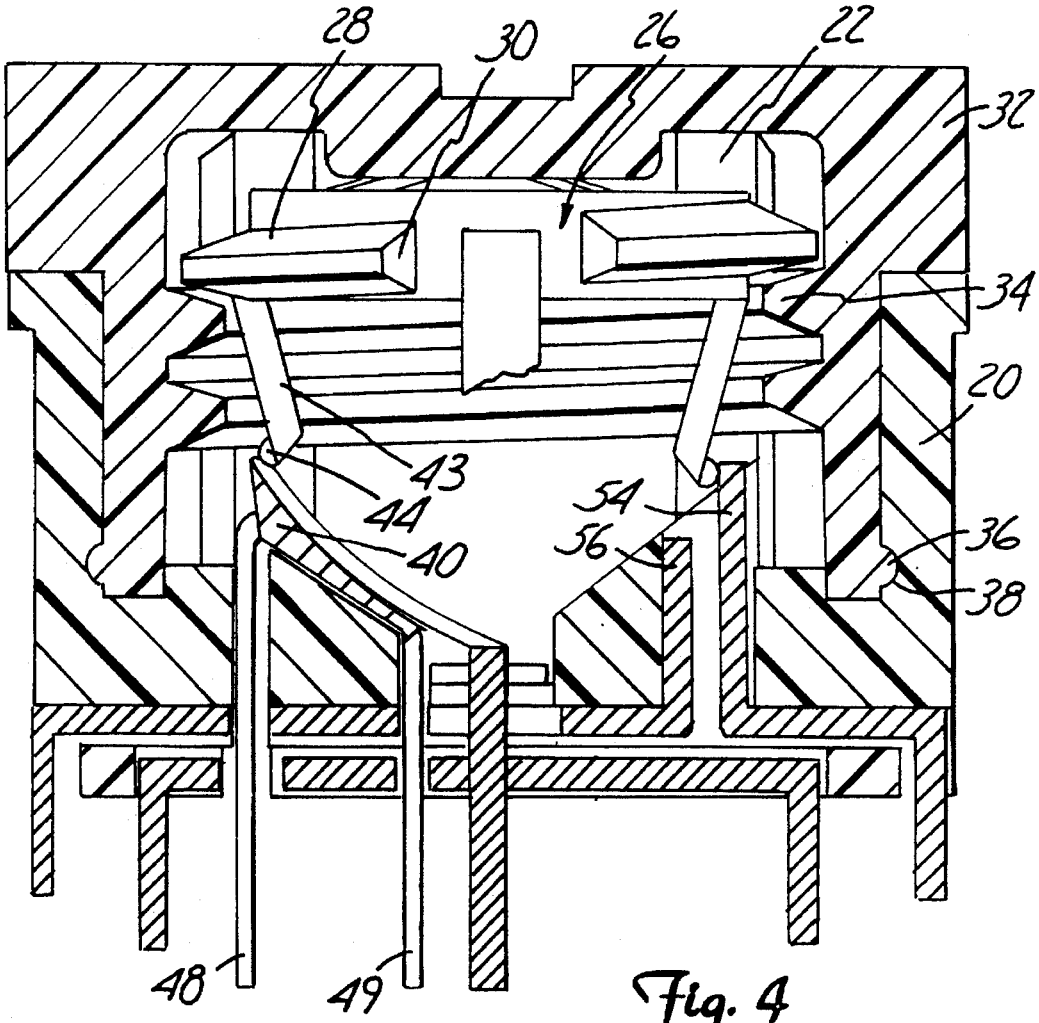
FIG. 4 shows a cross-sectional view of the embodiment depicted in FIG. 1 wherein the switch mechanism is in the open position.
Figure 3:
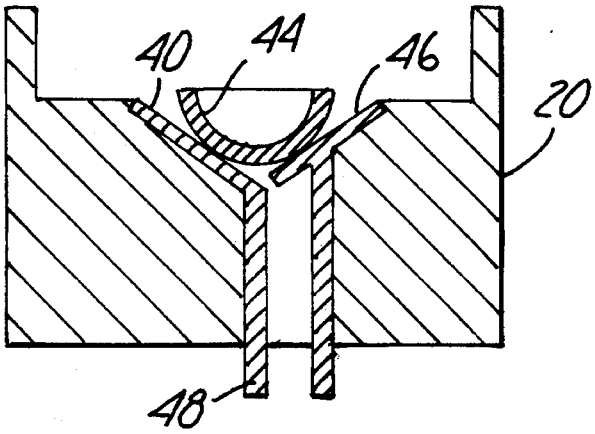
FIG. 3 shows a cross-sectional detail of the contact area taken at line A—A of FIG. 2 and perpendicular to the cross-section depicted therein.
Figure 5:
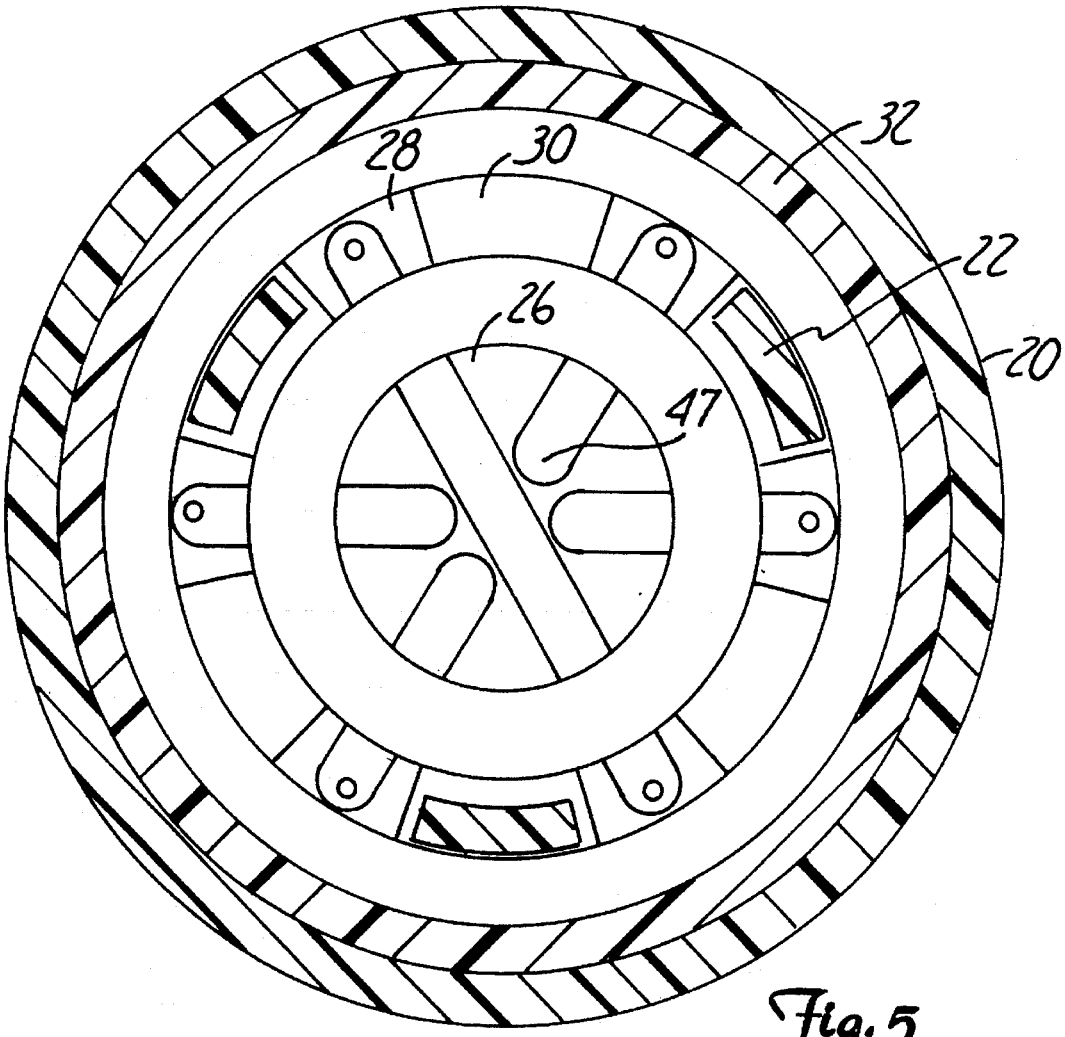
FIG. 5 shows a cross-sectional plan view of the embodiment depicted in FIG. 2 taken along line B—B.

Reference is now made to the drawings which illustrate an embodiment of the Multiple Range Variable Resistor. The housing 20 is formed of polymer resin, preferably Nylon 6,6 or other suitable material such as a 33% glass filled material, polycarbonate or bakelite. Other materials may now or later be found suitable for the housing. Posts 22 extend vertically upward from the base 24 of the housing 20. A non-rotatable disk 26 having external thread portions 28 which define a series of detents 30, preferably three, which fit about the posts 22 and prevent the disk from rotating while allowing it to move linearly along the axis of the generally cylindrical housing. The thread portions extend radially outward from the disk beyond the posts when the disk is installed in the housing.

The knob adaptor 32 serves as a cover for the internal components of the invention and is equipped with internal threads 34 which engage with the corresponding threads 28 of the non-rotatable disk 26. A ridge 36 which circumscribes the inner end of the knob adaptor is fittable into a corresponding groove 38 formed into the inside surface of the housing 20, and when fitted therein, secures the knob adaptor in operating position. It is to readily be understood that other securing means may also be used for securing the knob adaptor in operating position, for example, retaining pins, O-rings, snap rings, spring clip retainers, and the like.

One or more, preferably five, resistive elements 40 are attached to the housing 20. Although the configuration of the resistive elements is not critical, the preferred embodiment arranges them radially from the center of the housing and inclines the upper surfaces of the outer ends of the resistive elements upwardly with respect to the base 24 of the housing. Contact spring arms 43 depend from the non-rotatable disk at an acute angle and are oriented generally parallel to and above the resistive elements. The inclination of the upper surfaces of the resistive elements maximizes the longitudinal path of the contacts 44 which are attached to or formed from the contact spring arms 43 as they move along the resistive elements 40 and, optionally, the contact output slider spokes 46. It is to be understood that the contact output slider spokes are not essential to operation because the contacts may conveniently be electrically connected to a circuit by other means. Spring 47 is provided for biasing the non-rotatable disk into position for re-engagement of the threaded portions of the disk and the knob adaptor. In the preferred embodiment, the spring leaves 47, the contact arms 43, and the contacts 44 are formed in one piece by stamping from stainless spring steel. It is to be appreciated that the electrical connection between the contacts and the exterior of the housing may be made through the spring shown or by other means. The contacts may also be gold plated to reduce electrical noise and corrosion. It is also to be appreciated that the invention is not to be limited by shapes and orientations of the resistive elements shown in the drawings. Other embodiments of the invention may incorporate resistive elements having linear, helical or cylindrical shapes formed within or affixed to the housing.

The resistive elements may be made from a variety of formulations and materials. In the preferred embodiment, lead wires are extended through holes in the base of the housing into the ends of cavities which can hold the resistive elements. An electrically resistive curable ink can be injected into cavities molded into the base of the housing. When the ink is cured, it can then form the resistive element. The resistive elements may also be formed using conventional injection molding techniques and inserted into the housing individually or as a set. It is also possible that the resistive material can be a thick film polymer rather than a curable ink product. Furthermore, it is to be understood that the resistive elements may be formed of a variety of electrically resistive or semi-conductive materials including metallic compounds and organic compounds which may be molded or otherwise shaped to fit within a system such as that described herein.

The housing, disk, and knob adaptor may be made of the same material, or from different materials, preferably using injection molding. The disk may be made using insert molding to form the threaded portion of the disk and encapsulate the preferably unitary stainless steel part which forms the contact spring arms 43, contacts 44 and springs 47. Other fabrication techniques such as transfer molding may be used to make these pans. The contact arms are preferably bent to an angle of approximately 95 degrees or more after the molding process is completed. The angle at which the contact arms rest is of concern to assure that the contacts reliably form electrical interconnections during operation of the apparatus and to permit its assembly. The actual angle may vary in practice.

Solderable leadwires 48 are affixed to the ends of the resistive elements and extend through housing 20 for connection to terminal adapters 50 and 52. The terminal adapters are solderable strips affixed to the outside of the base of the housing 20. Terminal adapters are preferably fabricated of C-shaped strips of stainless steel arranged perpendicularly to and partially encircling the axis of the housing and having solderable attachment points which extend parallel to, but offset from, the axis of the housing. It is to be understood that suitable terminal adapters could be made of other materials having other shapes. Even a length of ordinary hook-up wire might serve as a terminal adaptor in certain applications by permitting electrical connection between the resistive elements and external circuitry. The terminal adapters are preferably fitted with holes large enough to permit the leadwires 48 to extend through the terminal adapters without making electrical contact. A technician may select the desired resistance range by choosing the appropriate leadwires to connect to the terminal adapters, and then connecting them using, for example, solder. It is to be understood that the materials from which the solderable pans are fabricated can include copper, bronze, nickel, brass, and stainless steel, among other things. A solderable coating such as gold over electroless nickel is normally applied to certain materials such as stainless steel in order to allow solder to be readily applied to the material.

Figure 6:
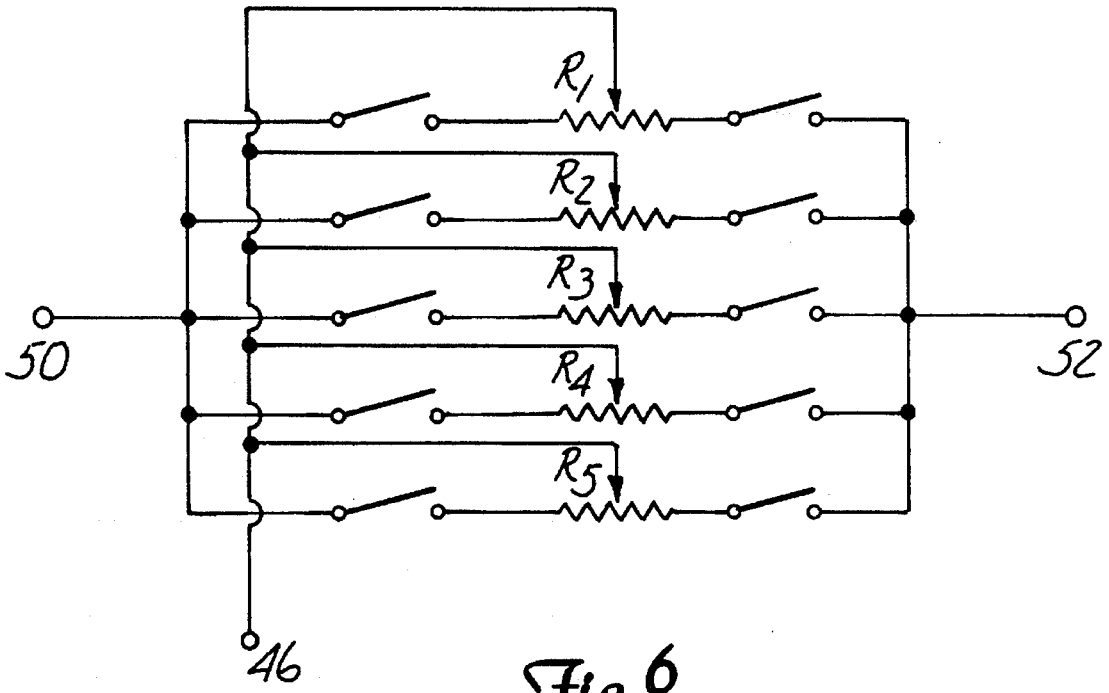
FIG. 6 shows an electrical schematic of the embodiment of the invention.
Figure 7:
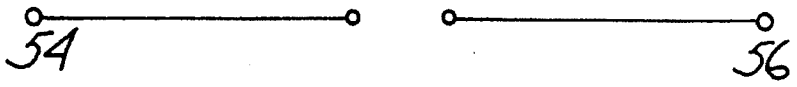
FIGS. 7 and 8 show electrical schematics of alternative switch mechanisms.
Figure 8:
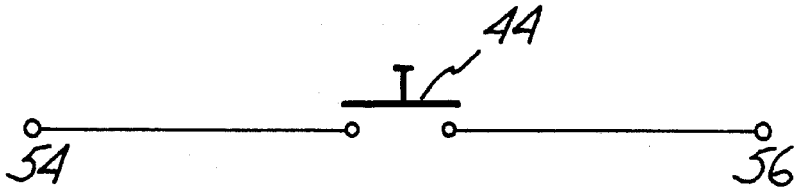

The electrical schematic shown in FIG. 6 may readily be modified for different applications. In particular, the present invention contemplates that the contacts 44 need not be electrically connected as shown in the drawing of the preferred embodiment. The illustrated embodiment includes what is believed to be a superior connection system which offers improved electrical performance over previously available methods by arranging the contact to slide between the resistive material and the connection to the wiper output. Furthermore, it is possible to make alternative embodiments wherein the wiper output 46 is comprised of a single spoke or replaced by a single conductor.

It is to be understood that the invention disclosed may be wired and used either as a variable potentiometer or as a variable resistor or as an adjustable resistor. When wired as a potentiometer, an electrical current would normally flow through the entire length of the selected resistive element whenever the circuit is active; the wiper would be adjusted to provide a potential intermediate between the potentials at which the circuit elements yielding the current flow were operating. When wired as a variable resistor, the current would flow only through the portion of the resistive material between the input lead and the wiper contact.

By using molded or otherwise formed resistive elements, the present invention can achieve any desired taper, depending on the application. It is also possible to control the response curve of the device by shaping the threaded portion to give the desired resistance output in response to the angular position of the knob adaptor.

A pair of switch contacts 54 and 56 are provided which may be operated by rotation of the knob adaptor 32 to move disk 26 along the axis of rotation of the knob adaptor or by other means. For example, a contact 44 formed in one of the spring mechanisms 47 could open the switch contacts as the disk is moved toward either extreme of the resistance range. Alternatively, the contact 44 could be used to make an electrical connection between parallel electrically conductive elements arranged in place of a resistive element assembly. Changes and modifications in the specifically described embodiments can be carried out without departing from the scope of the invention which is intended to be limited only by the scope of the appended claims.

What is claimed is:

1. A variable resistor comprising:

a housing;

a plurality of elongated resistive elements affixed to said housing, said resistive elements each having a first end and a second end;

means for connecting the first ends of each of said resistive elements to an electrical circuit;

means for selectably connecting the second ends of each of said resistive elements to an electrical circuit;

a plurality of contacts which can be moved between the end portions of said resistive elements while maintaining electrical connection with the surfaces of said resistive elements;

means for connecting said contacts to an electrical circuit;

means for moving said contacts between the first and second ends of said resistive elements comprised of:

a rotatable portion having threads;

a non-rotatable portion having corresponding threads, said non-rotatable portion disposed to move linearly along the axis of rotation of said rotaatable portion in response to rotation thereof;

means for connecting said contacts to said non-rotatable portion and;

retaining means for retaining said rotatable portion proximate to said housing and said resistive elements.

2. The variable resistor defined in claim 1 including:

means for allowing the threads of said rotatable portion to re-engagably disengage from the corresponding threads of said non-rotatable portion when the limit of linear movement of said non-rotatable portion is reached in either direction, and;

biasing means for biasing said non-rotatable portion into position for re-engagement engagement with said rotatable portion.

3. The variable resistor defined in claim 2 wherein said contacts are disposed between and electrically connected with said resistive elements and one or more conductive elements.

4. The variable resistor defined in claim 3 wherein said means for connecting the ends of said resistive elements to an electrical circuit is comprised of:

solderable electrical conductors connected to each end of each of said resistive elements;

a first buss made of a solderable electrically conductive material having apertures therein through which the electrical conductors connected to the first ends of said resistive elements may be fitted without creating an electrical connection;

a solder connection between a selected resistive element conductor and said first buss;

a terminal connected to said first buss;

a second buss made of a solderable electrically conductive material having apertures therein through which the electrical conductors connected to the second ends of said resistive elements may be fitted without creating an electrical connection;

a solder connection between said selected resistive element conductor and said second buss;

a terminal connected to said second buss.

5. The variable resistor defined in claim 4 wherein said resistive elements are comprised of polymer thick film having selectable resistive properties.

6. The variable resistor defined in claim 4 wherein said resistive elements are comprised of a moldable thermoplastic resin mixture having electrically resistive and conductive particles therein.

7. The variable resistor defined in claim 4 wherein said resistive elements are disposed radially about the central portion of a generally circular housing.

8. The variable resistor defined in claim 7 wherein the surfaces of said resistive elements communicating with said moveable contacts are oriented at an acute angle with respect to the axis of rotation of said rotatable portion.

9. The variable resistor defined in claim 8 wherein said conductive elements are comprised of a radially oriented array of metallic conductors, said array comprised of between one and ten spokes formed from one or more pieces of metal, and said conductors further arranged largely parallel to and in proximity with said resistive elements.

10. The variable resistor defined in claim 9 wherein the means for connecting said moveable contacts to said non-rotatable portion is comprised of elastic material affixed to said non-rotatable portion, said elastic material having linear segments radiating outward from a central point and having contacts on the outer ends of said linear segments for contacting said resistive elements, said linear segments being formed to an acute angle thereby biasing said contacts against the surfaces of said resistive elements continuously as said non-rotatable portion is moved linearly.

11. The variable resistor defined in claim 10 further comprising a switch operable in response to the linear position of said non-rotatable portion.

12. The variable resistor defined in claim 11 wherein at least one alignment post extends from said housing, said alignment posts fitting within corresponding detents in said non-rotatable portion thereby preventing rotation of said non-rotatable portion.

13. A variable resistor comprising:

a housing;

a plurality of generally helically shaped elongated resistive elements affixed to said housing, said resistive elements each having a first end and a second end;

means for connecting the first ends of each of said resistive elements to an electrical circuit;

means for selectably connecting the second ends of each of said resistive elements to an electrical circuit;

a plurality of contacts which can be moved between the end portions of said resistive elements while maintaining electrical connection with the surfaces of said resistive elements;

means for connecting said contacts to an electrical circuit;

means for moving said contacts between the first and second ends of said resistive elements comprised of:

a rotatable portion;

means for slidably connecting said rotaatable portion with said contacts;

means for connecting said contacts to said resistive elements, and;

retaining means for retaining said rotatable portion proximate to said housing and said resistive elements.

14. The variable resistor defined in claim 13 wherein at least one alignment post extends from said housing, said alignment posts fitting within corresponding detents in said non-rotatable portion thereby preventing rotation of said non-rotatable portion.

15. The variable resistor defined in claim 14 including:

means for allowing the threads of said rotatable portion to re-engagably disengage from the corresponding threads of said non-rotatable portion when the limit of linear movement of said non-rotatable portion is reached in either direction, and;

biasing means for biasing said non-rotatable portion into position for re-engagement with said rotatable portion.

16. The variable resistor defined in claim 15 having means for switching an electrical circuit, said switch means responsive to the position of the knob adaptor.

17. The variable resistor defined in claim 16 wherein said knob adaptor provides a protective cover to prevent contaminants from reaching the interior of the device when it is in operation.

18. The variable resistor defined in claim 17 wherein said means for connecting the ends of the resistive elements to an electrical circuit is comprised of:

lead wires extending from each end of said resistive elements through the housing; and terminal adapters disposed coaxially on the exterior of said housing.

19. A method of making a multiple range variable resistor comprising the steps of:

forming a polymeric housing using injection molding techniques and equipment;

affixing within said housing a multiplicity of elongated resistive elements disposed radially outwardly from the central axis of said housing;

providing means for electrically connecting each end of said elongated resistive elements selectably with solderable terminals on the exterior of said housing;

forming a polymer resin disk having a multiplicity of contact spring arms and springs of solderable stainless spring steel, each contact spring arm having an electrical contact on the outermost end, using the process of insert molding;

bending said contact spring arms to an angle with respect to said disk to enable said contacts to contact said elongated resistive elements when said disk is installed in said housing;

installing said disk in said housing;

providing means for electrically connecting said contact spring arms and contacts with solderable terminals on the exterior of said housing;

forming an internally threaded knob adaptor of polymer resin using the process of injection molding;

installing said knob adaptor on said housing;

engaging said disk with the internal threads of said knob adaptor;

installing solderable electrical terminals on the exterior of said housing;

connecting the ends of said elongated resistive elements to terminals on the exterior of said housing;

electrically connecting said contacts to terminals on the exterior of said housing.

* * * * *